US005131576A

United States Patent [19]

Turnipseed

[11] Patent Number: 5,131,576

[45] Date of Patent: Jul. 21, 1992

[54] BACKPACK SUPPORT DEVICE

[76] Inventor: Kent Turnipseed, 323 E. Matilya, Suite #112-140, Ojai, Calif. 93023

[21] Appl. No.: 583,212

[22] Filed: Sep. 17, 1990

[51] Int. Cl.[5] ..... A45F 3/08

[52] U.S. Cl. ..... 224/262; 224/211; 224/907

[58] Field of Search ..... 224/907, 262, 261, 211, 224/210

[56] References Cited

U.S. PATENT DOCUMENTS

| | | | |
|---|---|---|---|
| 1,761,426 | 6/1930 | Chute | 224/262 |
| 2,943,775 | 7/1960 | Mack | 224/211 |
| 3,938,718 | 2/1976 | Madison | 224/262 |
| 3,957,184 | 5/1976 | Shurman | 224/211 |
| 4,040,548 | 8/1977 | Guglielmo | 224/262 |
| 4,662,551 | 5/1987 | Dudley et al. | 224/262 |

*Primary Examiner*—Linda J. Sholl
*Attorney, Agent, or Firm*—David O'Reilly

[57] ABSTRACT

A backpack support device which utilizes interconnected front and back crossing straps and a separate waist strap, the straps providing for a more even distribution of the backpack load. The support device comprises a shaped member and a padded member affixed to the surface of the shaped member in contact with the wearer's back. The shaped member of the support device, shaped to the curvature of a wearer's back, and the interconnection points of the crossing straps and the waist belt over the femur joint enable the load from the backpack to be more evenly distributed along the entire back of the wearer.

6 Claims, 2 Drawing Sheets

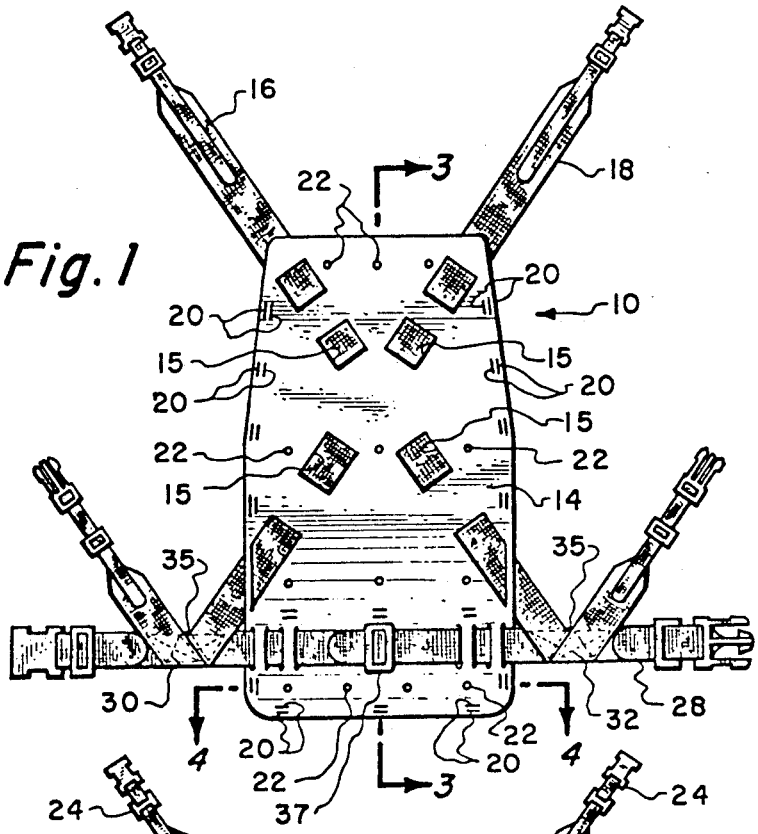
Fig. 1
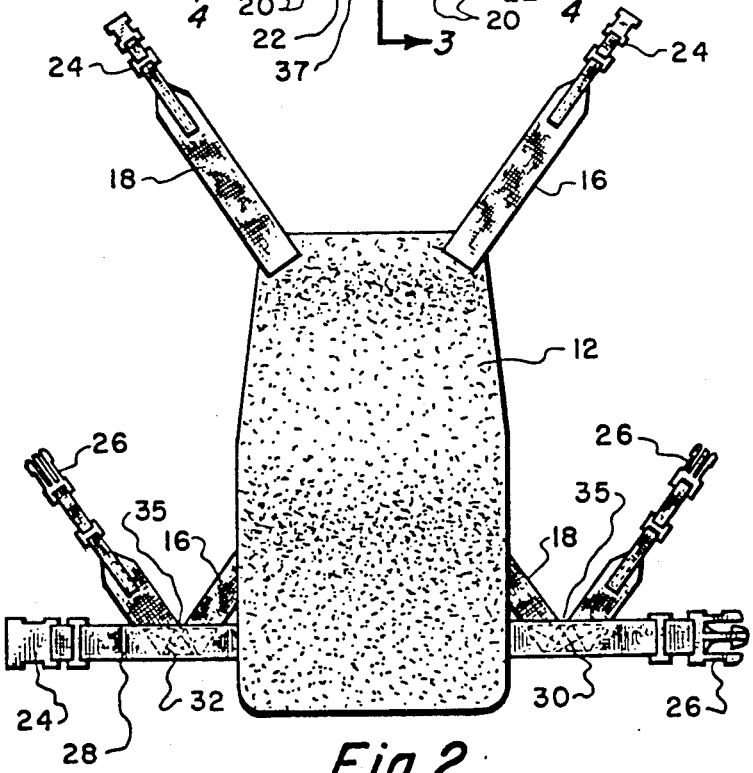
Fig. 2.
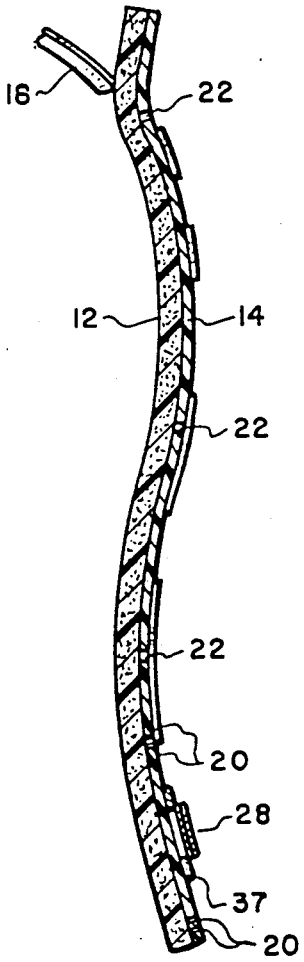
Fig. 3.
Fig. 4.
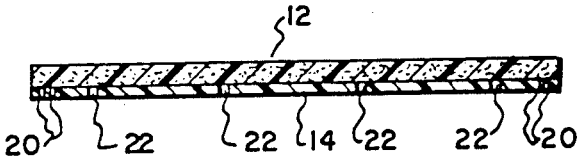

BACKPACK SUPPORT DEVICE

BACKGROUND OF THE INVENTION

1. Field of Use

The present invention provides an improved backpack support device which more evenly distributes the backpack load over a wearer's back.

2. Description of the Prior Art

As is well known, various backpacks and backpack support devices have been available in the prior art. A typical prior art device comprises a vertically extending aluminum frame member, the backpack attached to one side thereof, padded curved shoulder straps, a padded hip belt extending from the other surface of the vertical aluminum support member and a sternum strap between both shoulder straps. A serious disadvantage with this type of backpack support device is that it is uncomfortable and does not properly distribute the load from the backpack across the wearer's body. In addition, it is more difficult for the wearer to perform other activities while the backpack is being worn. For example, the positioning of the standard vertical shoulder straps makes it difficult to support and then accurately fire rifle since the stock of the rifle tends to abut against the shoulder strap. The prior art devices, exemplified by the above-described device, inhibit free movement of the arms and shoulders necessary for different activities while the backpack is being worn and do not evenly distribute the backpack load over a wearer's back. Typical of various other backpack related devices available in the prior art are those shown in U.S. Pat. No. 3,964,654 to Wittenberger which discloses a pack strap design used to secure a pack to the human body, the straps running from each shoulder to the opposite side of the wearer's body; U.S. Pat. No. 4,480,775 to Stanford which discloses a pack frame having a pair of vertical standards, a top bar and a bottom bar internally connecting the standards and a U-shaped bar integrally extending at its ends from the vertical standard in a horizontal plane; U.S. Pat. No. 2,943,775 to Mack which discloses a backpack and harness for carrying a gas cylinder, the harness including crossing shoulder straps over the user's chest and a base frame member positioned against the wearer's back; U.S. Pat. No. 3,486,671 to Sanders which discloses a litter backpack assembly having anchor straps connected to a back section; and U.S. Pat. No. 4,750,654 to Menetrier which discloses a backpack having a front panel therein and having a shape generally conforming to that of the back of the wearer and comprising a synthetic resin having a cellular synthetic resin which contacts the back of the wearer. In essence, existing packs are typically suspended by shoulder straps and are attached to frames which are not shaped like the human back. The pack leans away from the shoulders, throwing the weight away from the body and against the lower back and hips and pulling back on the shoulders, thus keeping the weight behind the wearer.

SUMMARY OF THE PRESENT INVENTION

The present invention provides an improved backpack support device comprising a padded shaped member having strap receiving apertures formed therein and shoulder straps arranged to be inserted in the apertures in a manner to cross both in the front and the back of the wearer and a waist belt, the shoulder belts being attached to the waist belt over the femur joint areas.

The curved shape of the device, shaped generally to conform to the structure of the wearer's back and the arrangement of the crossing shoulder straps and the interconnection to the waist belt at the femur joints distributes the load from the backpack in a manner such that the backpack support device of the present invention distributes the load more evenly. In addition, the backpack support device of the present invention allows the wearer to move relatively freely and to participate in other activities while the backpack is being worn.

DESCRIPTION OF THE DRAWINGS

For a better understanding of the invention as well as other objects and further features thereof, reference is made to the following description which is to be read in conjunction with the accompanying drawing wherein:

FIG. 1 is a rear view of the backpack support device of the present invention;

FIG. 2 is a front view of the backpack support system shown in FIG. 1;

FIG. 3 is a cross-sectional view along line 3—3 of FIG. 1;

FIG. 4 is a cross-sectional view along line 4—4 of FIG. 1;

DESCRIPTION OF THE INVENTION

Figure 7:
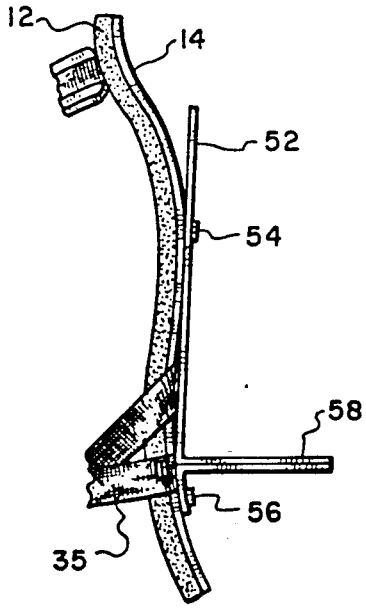
FIG. 7 illustrates the backpack support device of the present invention with a detached platform member mounted thereto.

FIGS. 1-4 illustrate the backpack support device 10 of the present invention (as noted hereinabove, FIG. 1 is the rear view of device 10—the term "rear" in this context describes the portion of device 10 not in contact with the wearer's back). Device 10 comprises closed cell foam padding 12 having a thickness in the range from about ¾" to about 1". Padding 12 is affixed to a support member 14 which may be fabricated from plastic, aluminum, fiberglass, wood, metal or a combination of these components. Although it is preferred that member 14 be flexible, it is not required. Padding 12 may be affixed to member 14 in a number of ways, including the use of adhesive. Shoulder straps 16 and 18 are secured to the support member 14 and prevented from shifting by interlacing the straps through a plurality of apertures, or slots, 15 formed in member 14. The criss-cross strap arrangement on the rear of device 10 is repeated across the front of device 10 (FIG. 2) to provide a more even load distribution for a wearer. The connection of the shoulder straps in the front and back in an "X" type, or criss-cross, configuration provides more surface area devoted to support. The compression of the configuration from front to back when the straps are tightened, and the flexible back support, distributes the load evenly over a much larger area than existing backpacks which place the entire load on the shoulder straps, with the upper part of the pack leaning away from the body, distributing the weight entirely behind the carrier, and pressing against the lower back as noted hereinabove. After the straps are tightened, the lower portion, or bottom legs, of each come together over the femur joints as shown in FIG. 7, directing more of the load toward the natural center of the body.

A plurality of slots 20 are provided for compressing the main backpack load and securing different loads other than the main pack itself. A plurality of apertures 22 are provided to enable a particular backpack to be secured to member 14 such as, for example, by attaching the backpack support bar to member 14 through apertures 22. As illustrated, a quick-release arrangement comprising female and male portions 24 and 26 respectively are provided on the shoulder straps 16 and 18 and on waist belt 28. Shoulder strap 18 is attached to belt 28 via stitching 30 and shoulder belt 16 is attached to belt 28 via stitching 32 as illustrated, stitching 30 and 32 being located at the femur joint area 35.

The gentle "S" shaped curve of member 14 approximates the typical curve of the spine, and foam padding 12 on the inside thereof allows member 14 to be tightened snugly against the wearer's back. This will distribute the weight more evenly against the wearer's back, with the lower portion of the straps coming together over the femur sockets to direct as much of the weight as possible over the center of the body. The solid, yet flexible, structure of member 14 also protects the wearer's back from the protrusion of the contents of the pack, i.e. cooking utensils, firearms, shoes. The top of member 14 extending above the shoulders provides a structure for packs that have a sleeve at the top to fit over the pack frame, such as a pack utilized by the military.

Figure 5:
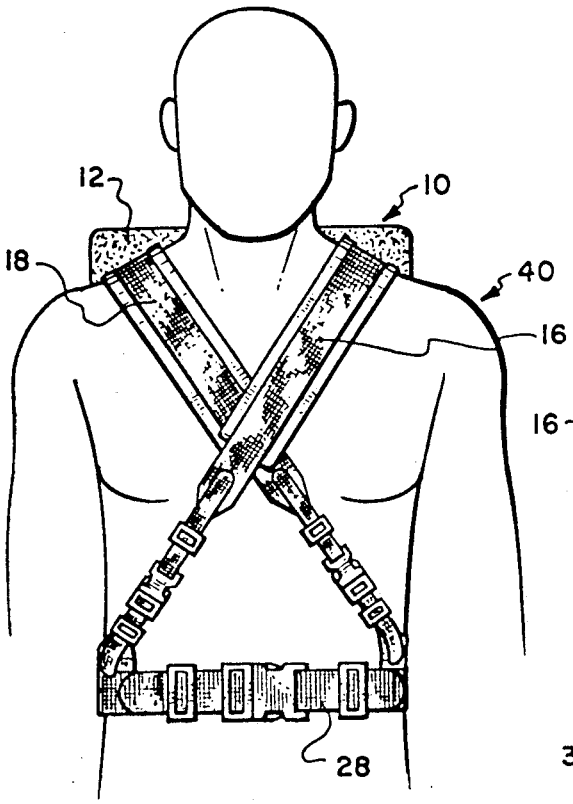
FIG. 5 is a front view illustrating the backpack device of the present invention worn by a user and illustrating the crossover shoulder strap design.
Figure 6:
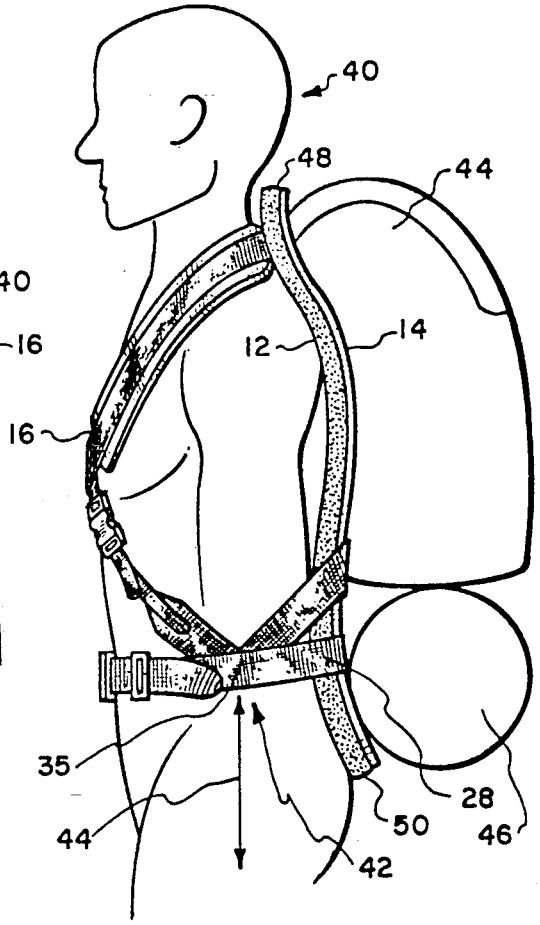
FIG. 6 is a side view illustrating the backpack support device of the present invention being worn by a user and illustrating the connection of the crossover front and back shoulder straps to the waist belt adjacent the femur joint area.

Referring now to FIG. 5, the support device of the present invention is shown being worn by a user 40. It is noted that the shoulder straps 16 and 18 extend from the rear surface of support member 14 over the shoulders of wearer 40 and form a criss-cross pattern across the chest area of the wearer. FIG. 6 illustrates the connection of the criss-cross pattern of the front and back straps to the waist belt side on the side of the user's body over the femur socket, or joint, area 42, enabling the backpack load to be distributed along the axis indicated by reference numeral 44. Positioning of the support device so that the interconnections of straps 16 and 18 to waist belt 28 are always located approximately adjacent to the femur joint areas is accomplished by adjusting buckle 37 located at the back of the waist belt, behind member 14. This allows the wearer to adjust the length of each side of the waist belt and thereby position the interconnections over his/her femur socket. FIG. 6 also illustrates backpack 44 and bedroll 46 being supported by the backpack support device of the present invention. Obviously, the device can also support backpacks alone. The back support device 10 follows the curvature of the wearer's spine from the neck area 48 through the tailbone 50, thus distributing weight over the entire back area and also supporting the back and spinal column as noted hereinabove. The load is held firmly against the wearer's back preventing shifting and chaffing. The foam padding 12 between the wearer's body and member 14 allows for normal variations in back shape and also cushions the load.

As shown in FIG. 7, a detachable platform 52 may be secured to the back support device of the present invention through bolts 54 and 56 in selected apertures 22, a relatively horizontal portion 58 being provided to support things such as field radios, gas cans, large boxes, and scuba gear.

The present invention thus provides a backpack support device which provides significant advantages over those found in the prior art. In particular, the criss-crossing shoulder strap arrangement and the fact that the back and front straps are connected over the femur joint area allows the weight on the backpack support device to be more evenly distributed making it easier for the wearer to perform various activities. The strap cross pattern in the front of the device allows the wearer to have more freedom in arm movement than provided by shoulder straps which are essentially parallel to each other. The quick-release system on the shoulder straps and the waist belt allow the backpack load to be removed with relative ease. The backpack support device can be easily adapted to support various types of breathing apparatus such as that required by fire departments and scuba activities. Finally, the curvature of the support device simulating the curvature of the wearer's spine also provides an efficient distribution of the load, thus making the backpack easier to carry with less effort on the part of the wearer.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

WHAT IS CLAIMED IS:

1. A support for carrying a load on the back of a wearer comprising;

a solid back support having a curvature conforming to the shape of the spine to distribute a load over the back;

said solid back support having a plurality of slots adjacent a lower edge;

belt means passing through said slots for securing said solid back support to the waist of a wearer;

said solid back support having a plurality of slots in a diagonal crossing pattern from the bottom to the top;

a pair of support straps, an intermediate portion of each of said pair of support straps being securely fastened to said belt means at a point substantially above the joint of the wearer;

said support straps passing crosswise through said diagonal slots and over the shoulders and diagonally in a crossing pattern across the chest of the wearer, the ends of each of said pair of support straps meeting at a point below the chest;

adjustable fastening means for fastening the respective ends of each of said pair of support straps;

said solid back support having a plurality of apertures for fastening a load;

whereby said load is distributed evenly across the back and the weight is substantially supported at the center of gravity of the wearer where said pair of support straps join said belt.

2. The support device according to claim 1 in which said solid back support includes resilient padding on the side that rests on the back.

3. The support device according to claim 1 including means for adjusting the length of said belt so that the point where said straps join said belt can be positioned substantially directly over the femur joint when on a wearer.

4. The support device according to claim 1 in which said solid support member is flexible.

5. The support device according to claim 2 in which said solid support member is flexible.

6. The support device according to claim 2 including means for adjusting the length of said belt so that the point where said straps join said belt can be positioned substantially directly over the femur joint when on a wearer.

* * * * *